US009644825B2

(12) United States Patent
Son et al.

(10) Patent No.: US 9,644,825 B2
(45) Date of Patent: May 9, 2017

(54) LIGHTING DEVICE

(71) Applicant: LG Innotek Co., Ltd., Seoul (KR)

(72) Inventors: Eon Ho Son, Seoul (KR); Mi Na Shin, Seoul (KR); Young Joo Ahn, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 366 days.

(21) Appl. No.: 14/332,806

(22) Filed: Jul. 16, 2014

(65) Prior Publication Data

US 2015/0062869 A1 Mar. 5, 2015

(30) Foreign Application Priority Data

Aug. 30, 2013 (KR) ..... 10-2013-0103580

(51) Int. Cl.
*F21V 23/02* (2006.01)
*F21K 99/00* (2016.01)
(Continued)

(52) U.S. Cl.
CPC ..... *F21V 23/02* (2013.01); *F21K 9/20* (2016.08); *F21K 9/64* (2016.08); *F21V 29/70* (2015.01);
(Continued)

(58) Field of Classification Search
CPC ..... F21V 29/22; F21K 9/10; F21K 9/56
See application file for complete search history.

(56) References Cited

U.S. PATENT DOCUMENTS 9,091,427 B2 * 7/2015 Huang ..... G02F 1/133514
2004/0051445 A1 3/2004 Adachi
(Continued)

OTHER PUBLICATIONS

Sakuma et al., "White Light-Emitting Diode Lamps Using Oxynitride and Nitride Phosphor Materials," The Institute of Electronics, Information and Communication Engineers Transactions on Electronics, vol. E88-C, No. 11, Nov. 2005, pp. 2057-2064, XP8147238.

*Primary Examiner* — Anabel Ton
(74) *Attorney, Agent, or Firm* — Birch, Stewart, Kolasch & Birch, LLP

(57) ABSTRACT

A lighting device may be provided that includes: a light source which includes a blue light emitting device emitting blue light, and a red light emitting device emitting red light in a visible light spectrum; an optical exciter which is disposed on the light source, is spaced apart from the blue light emitting device and the red light emitting device, and includes at least one phosphor; and a power supply unit which is electrically connected to the light source and controls on/off of the blue light emitting device and the red light emitting device. When the blue light emitting device is an on-state and the red light emitting device is an off-state by the power supply unit, light emitted from the optical exciter is disposed within a specific area on a CIE 1931 chromaticity diagram. The specific area is formed by connecting three color coordinates, and the three color coordinates are (0.32, 0.4), (0.36, 0.5) and (0.368, 0.49). When the blue light emitting device and the red light emitting device are an on-state, the light emitted from the optical exciter is disposed within a predetermined target color coordinate range on the CIE 1931 chromaticity diagram.

20 Claims, 2 Drawing Sheets

(51) Int. Cl.

| | |
|---|---|
| ***H05B 33/08*** | (2006.01) |
| ***F21V 29/70*** | (2015.01) |
| ***F21K 9/20*** | (2016.01) |
| ***F21K 9/64*** | (2016.01) |
| *F21Y 101/00* | (2016.01) |

(52) U.S. Cl.
CPC ..... *H05B 33/0857* (2013.01); *F21Y 2101/00* (2013.01)

(56) References Cited

U.S. PATENT DOCUMENTS

| | | | | |
|---|---|---|---|---|
| 2007/0267983 | A1* | 11/2007 | Van De Ven ..... | F21K 9/00 315/294 |
| 2010/0027244 | A1 | 2/2010 | Wada et al. | |
| 2010/0295464 | A1 | 11/2010 | Kasakura et al. | |
| 2011/0278606 | A1 | 11/2011 | Suzuki et al. | |
| 2012/0248424 | A1 | 10/2012 | Sasaki | |
| 2013/0141013 | A1 | 6/2013 | Kodama et al. | |
| 2016/0116121 | A1* | 4/2016 | Hu ..... | G02F 1/133603 362/84 |

* cited by examiner

LIGHTING DEVICE

CROSS-REFERENCE TO RELATED APPLICATION

The present application claims priority under 35 U.S.C. §119(e) of Korean Patent Application No. 10-2013-0103580 filed Aug. 30, 2013 the subject matters of which are incorporated herein by reference.

BACKGROUND

1. Field

Embodiments may relate to a lighting device.

2. Background

A light emitting diode (LED) is an energy device for converting electric energy into light energy. Compared with an electric bulb, the LED has higher conversion efficiency, lower power consumption and a longer life span. As the advantages are widely known, more and more attentions are now paid to a lighting apparatus using the LED.

SUMMARY

One embodiment is a lighting device. The lighting device comprises: a light source which includes a blue light emitting device emitting blue light in a visible light spectrum, and a red light emitting device emitting red light; an optical exciter which is disposed on the light source, is spaced apart from the blue light emitting device and the red light emitting device, and includes at least one phosphor; and a power supply unit which is electrically connected to the light source and controls on/off of the blue light emitting device and the red light emitting device. When the blue light emitting device is an on-state and the red light emitting device is an off-state by the power supply unit, light emitted from the optical exciter is disposed within a specific area on a CIE 1931 chromaticity diagram. The specific area is formed by connecting three color coordinates, and the three color coordinates are (0.32, 0.4), (0.36, 0.5) and (0.368, 0.49). When the blue light emitting device and the red light emitting device are an on-state, the light emitted from the optical exciter is disposed within a predetermined target color coordinate range on the CIE 1931 chromaticity diagram.

Another embodiment is a lighting device. The lighting device includes: a heat sink; a light source including a substrate disposed on one side of the heat sink, at least one first LED chip which is disposed on a top surface of the substrate and has a dominant wavelength of from 430 nm to 480 nm, and at least one second LED chip which is disposed on the top surface of the substrate and has a dominant wavelength of from 600 nm to 650 nm; an optical exciter emitting excites and emits light emitted from the first LED chip and the second LED chip; and a power supply unit which controls on/off of the first LED chip and the second LED chip. When the first LED chip is an on-state and the second LED chip is an off-state by the power supply unit, light emitted from the optical exciter is disposed within a specific area on a CIE 1931 chromaticity diagram. The specific area is formed by connecting three color coordinates, and the three color coordinates are (0.32, 0.4), (0.36, 0.5) and (0.368, 0.49). When the first LED chip and the second LED chip are an on-state, the light emitted from the optical exciter is disposed within a predetermined target color coordinate range on the CIE 1931 chromaticity diagram.

BRIEF DESCRIPTION OF THE DRAWINGS

Arrangements and embodiments may be described in detail with reference to the following drawings in which like reference numerals refer to like elements and wherein.

DETAILED DESCRIPTION

A thickness or a size of each layer may be magnified, omitted or schematically shown for the purpose of convenience and clearness of description. The size of each component may not necessarily mean its actual size.

It should be understood that when an element is referred to as being 'on' or "under" another element, it may be directly on/under the element, and/or one or more intervening elements may also be present. When an element is referred to as being 'on' or 'under', 'under the element' as well as 'on the element' may be included based on the element.

An embodiment may be described in detail with reference to the accompanying drawings.

Figure 1:
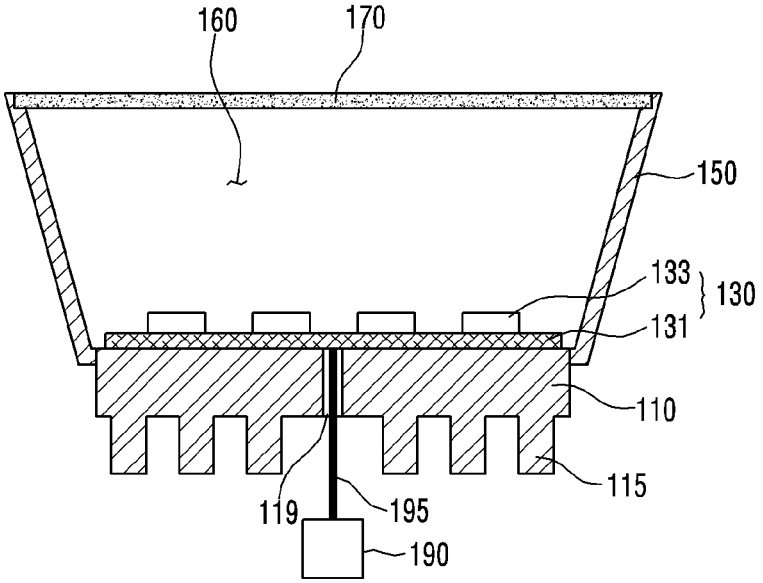
FIG. 1 is a view for describing a lighting device according to an embodiment.

FIG. 1 is a view for describing a lighting device according to an embodiment.

Referring to FIG. 1, the lighting device according to the embodiment may include a heat sink 110, a light source 130, a reflector 150, an optical exciter 170, and a power supply unit 190.

The heat sink 110 may receive heat from the light source 130 and radiate to the outside. The heat sink 110 may be formed of a metallic material or a resin material which has excellent heat radiation efficiency. However, there is no limit to the material of the heat sink 110. For example, the material of the heat sink 110 may include at least one of Al, Ni, Cu, Ag, and Sn.

The heat sink 110 has one side on which the light source 130 is disposed. A substrate 131 of the light source 130 may be disposed on the side. Here, the side may be flat or curved upward and downward at a predetermined curvature.

The heat sink 110 may have a heat radiating fin 115. The heat radiating fin 115 may protrude or extend outwardly from the exterior or surface of the heat sink 110. The heat radiating fin 115 increases a heat radiating area of the heat sink 110. Therefore, thanks to the heat radiating fin 115, a heat radiation efficiency of the lighting device according to the embodiment can be improved.

The heat sink 110 may have a hole 119. A conductive member 195 which electrically connects the power supply unit 190 and the light source 130 may be disposed in the hole 119.

The light source 130 is disposed on the heat sink 110 and emits predetermined light above the heat sink 110.

The light source 130 may include a substrate 131 and a light emitting device 133.

The substrate 131 may be one of a general PCB, a metal core PCB (MCPCB), a standard FR-4 PCB, and a flexible PCB. The substrate 131 may contact directly with the heat sink 110, or a thermally conductive member may be disposed between the substrate 131 and the heat sink 110.

The substrate 131 may have one of a circular shape, an elliptical shape, and a polygonal shape.

The substrate 131 may be disposed on one side of the heat sink 110. The bottom surface of the substrate 131 may contact with the one side of the heat sink 110.

The at least one light emitting device 133 may be disposed on the substrate 131. A plurality of the light emitting devices 133 may be arranged on the top surface of the substrate 131 in a predetermined shape. The plurality of the light emitting devices 133 may be arranged in a plurality of columns and rows or may be radially arranged.

A light reflective material may be coated on deposited on the top surface of the substrate 131 in order to easily reflect light from the light emitting device 133

The substrate 131 may selectively have a thermally conductive adhesive tape or thermal pad for structural purpose and/or for enhancing the heat transfer to the heat sink 110.

The plurality of the light emitting devices 133 may be disposed on the substrate 131. The plurality of the light emitting devices 133 may emit lights having the same wavelength or may emit lights having different wavelengths. Also, the plurality of the light emitting devices 133 may emit lights having the same color or may emit light having mutually different colors.

The plurality of the light emitting devices 133 may include a blue light emitting device emitting blue light in a visible light spectrum, and a red light emitting device emitting red light in a visible light spectrum.

The plurality of the light emitting devices 133 may include the at least one blue light emitting device and the at least one red light emitting device.

The plurality of the light emitting devices 133 may include a first light emitting device having a dominant wavelength of from 430 nm to 480 nm and a second light emitting device having a dominant wavelength of from 600 nm to 650 nm. Here, the plurality of the light emitting devices 133 may include the at least one first light emitting device and the at least one second light emitting device.

The plurality of the light emitting devices 133 may be a light emitting diode (LED) chip. Specifically, the light emitting device 133 may include at least one blue LED chip emitting blue light in a visible light spectrum, and at least one red LED chip emitting red light in a visible light spectrum. Also, the light emitting device 133 may include at least one first LED chip having a dominant wavelength of from 430 nm to 480 nm and at least one second LED chip having a dominant wavelength of from 600 nm to 650 nm.

The reflector 150 reflects light from the light source 130.

The reflector 150 encloses the light source 130 and may reflect the light emitted from the light source 130 to the optical exciter 170.

The lower portion of the reflector 150 is coupled to the heat sink 110. The optical exciter 170 may be disposed on the upper portion of the reflector 150.

The light source 130 and the optical exciter 170 may be spaced apart from each other by the reflector 150.

The reflector 150 may have a reflective surface reflecting the light from the light source 130. The reflective surface may be substantially perpendicular to the substrate 131 or may form an obtuse angle with the top surface of the substrate 131. That is, an angle between the reflective surface and the top surface of the substrate 131 may be equal to or greater than 90° to less than and not equal to 180°. The reflective surface may be coated or deposited with a material capable of easily reflecting the light.

The optical exciter 170 excites the light emitted from the light source 130. Also, the optical exciter 170 may excite the light which is emitted from the light source 130 and then is reflected by the reflector 150.

The optical exciter 170 is disposed spaced apart from the light source 130 at a predetermined interval. The optical exciter 170 may be disposed on the upper portion of the reflector 150 so as to be spaced apart from the light source 130 at a predetermined interval.

The optical exciter 170 may have a flat plate shape. However, there is no limit to the shape of the optical exciter 170. The optical exciter 170 may be a plate having a shape of which the particular portion is upwardly or downwardly convex.

A mixing space 160 may be formed by the optical exciter 170, the reflector 150, and the heat sink 110. The mixing space 160 refers to a space in which the lights emitted from the light source 130 or the lights which are emitted from the light source 130 and reflected by the reflector 150 are mixed.

The optical exciter 170 may include at least one phosphor. Specifically, the optical exciter 170 may include at least one of a yellow phosphor, a green phosphor, and a red phosphor. For example, the optical exciter 170 may include a single yellow phosphor, or may include the yellow phosphor and the green phosphor. Also, the optical exciter 170 may include all of the yellow, green and red phosphors.

The optical exciter 170 may include any one of the yellow, green and red phosphors, or may include at least two phosphors having mutually different dominant wavelengths.

The optical exciter 170 may include a first phosphor having a dominant wavelength of from 557.5 nm to 562 nm. Also, the optical exciter 170 may include a second phosphor having a dominant wavelength of from 537.5 nm to 542.5 nm and a third phosphor having a dominant wavelength of from 547.5 nm to 552.5 nm.

The power supply unit 190 generates a driving signal for causing the plurality of the light emitting devices 133 of the light source 130 to be in an on-state by being supplied with electric power from an external power supply, and then provides the generated driving signal to the light source 130. Here, the driving signal for causing the plurality of the light emitting devices 133 to be in an on-state may be an electric current.

The driving current which is provided from the power supply unit 190 to the plurality of the light emitting devices 133 may vary depending on the kind of the light emitting device 133. Specifically, when the plurality of the light emitting devices 133 include the at least one blue light emitting device (or the first light emitting device) and the at least one red light emitting device (or the second light emitting device), the power supply unit 190 may provide a driving current of from 200 mA to 300 mA to the blue light emitting device (or the first light emitting device) and may provide a driving current of from 240 mA to 350 mA to the red light emitting device (or the second light emitting device). Depending on the driving current which is provided to the blue light emitting device (or first light emitting device) and the red light emitting device (or the second light emitting device), a color rendering index (CRI) of the light emitted from the lighting device according to the embodiment can be improved, and targeted color coordinates Cx and Cy and correlated color temperature (CCT) of the light can be implemented. Detailed descriptions thereof will be provided later with reference to FIG. 3.

The power supply unit 190 may be disposed under the heat sink 110. Also, while not shown in the drawings, the power supply unit 190 may be disposed within the heat sink 110. In this case, the power supply unit 190 may be disposed in a receiver (not shown) formed within the heat sink 110.

The power supply unit 190 may include the conductive member 195. The conductive member 195 may electrically connect the power supply unit 190 and the light source 130. Specifically, the conductive member 195 may be a wire or an electrode pin. The conductive member 195 may be disposed in the hole 119 of the heat sink 110.

Figure 2:
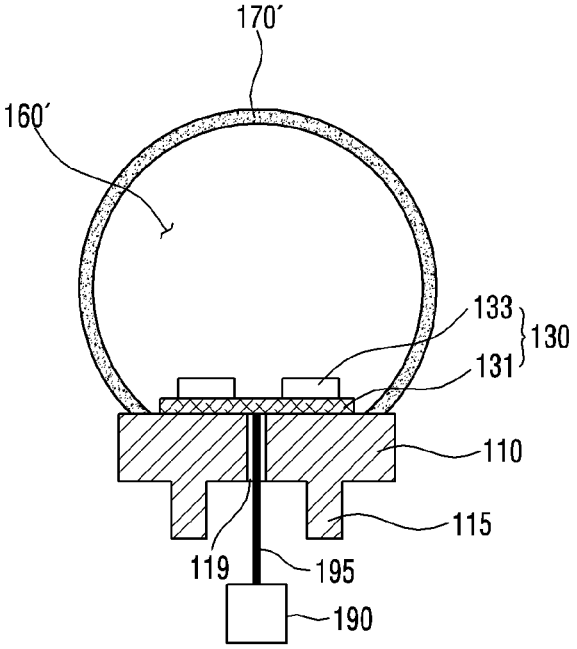
FIG. 2 is a view for describing a lighting device according to another embodiment.

FIG. 2 is a view for describing a lighting device according to another embodiment.

Compared with the lighting device according to the embodiment shown in FIG. 1, the lighting device according to another embodiment shown in FIG. 2 has no reflector 150 shown in FIG. 1 and includes an optical exciter 170' having a shape different from that of the optical exciter 170 shown in FIG. 1. Since the components other than the optical exciter 170' are the same as those of the lighting device according to the embodiment shown in FIG. 1, the following description will focus on the optical exciter 170'. Here, the optical exciter 170' shown in FIG. 2 is the same as the optical exciter 170 shown in FIG. 1, except for the fact that theirs shapes are different from each other.

Referring to FIG. 2, the optical exciter 170' may have a spherical shape. The optical exciter 170' may be disposed on the inner or outer surface of a globe of a bulb type lighting device or may take the place of the globe.

The shape of the optical exciter 170' is not limited to the spherical shape. For example, the optical exciter 170' may have a hemispherical shape, an elliptical shape, or a polygonal box shape.

The optical exciter 170' is disposed on the heat sink 110 and may be coupled to the heat sink 110.

Depending on the on/off of the red light emitting device (or the second light emitting device) among the plurality of the light emitting devices 133 and on the driving current applied to the red light emitting device (or the second light emitting device), the color coordinates, color temperature and CRI of the lights emitted from the optical exciters 170 and 170' of the lighting devices according to the two embodiments shown in FIGS. 1 and 2 may be changed on a CIE 1931 chromaticity diagram. In other words, in the lighting devices according to the two embodiments shown in FIGS. 1 and 2, the color coordinates and color temperature can be implemented and CRI can be improved depending on the on/off of the red light emitting device (or the second light emitting device) among the plurality of the light emitting devices 133 and on the driving current applied to the red light emitting device (or the second light emitting device). Specifically, the characteristics of the lights emitted from the optical exciters 170 and 170' of the lighting devices according to the two embodiments shown in FIGS. 1 and 2 will be described with reference to FIG. 3.

Figure 3:
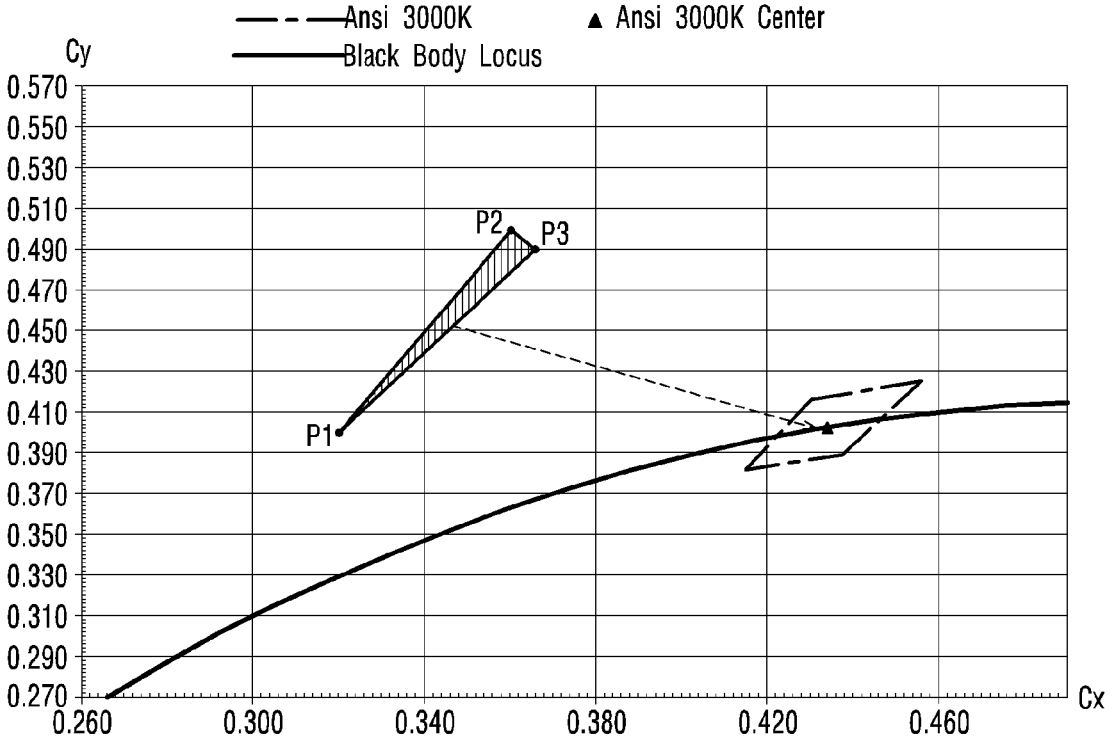
FIG. 3 is a CIE 1931 chromaticity diagram showing lights emitted from optical exciters of the lighting devices according to the two embodiments shown in FIGS. 1 and 2.

FIG. 3 is a CIE 1931 chromaticity diagram showing the lights emitted from the optical exciters of the lighting devices according to the two embodiments shown in FIGS. 1 and 2.

Referring to FIG. 3, the lights emitted from the optical exciters 170 and 170' of the lighting devices according to the two embodiments shown in FIGS. 1 and 2 may move from a specific area consisting of P1, P2 and P3 to a target color coordinate range (Ansi 3000K) on the CIE 1931 chromaticity diagram. The coordinate movement on the CIE 1931 chromaticity diagram can be controlled by the operation of the red light emitting device (or the second light emitting device) and the driving current applied to the red light emitting device (or the second light emitting device).

In a state where the blue light emitting device (or the first light emitting device) is an on-state and the red light emitting device (or the second light emitting device) is an off-state, when only the blue light emitting device (or the first light emitting device) among the plurality of the light emitting devices 133 in the lighting devices according to the two embodiments shown in FIGS. 1 and 2 is operated, the lights emitted from the optical exciters 170 and 170' are located within a specific area consisting of P1, P2 and P3 on the CIE 1931 chromaticity diagram. The specific area is formed by connecting P1, P2, and P3 on the CIE 1931 chromaticity diagram. P1 may have color coordinates of (0.32, 0.4), P2 may have color coordinates of (0.36, 0.5), and P3 may have color coordinates of (0.368, 0.49). Here, the driving current which is applied from the power supply unit 190 to the blue light emitting device (or the first light emitting device) may be from 200 mA to 300 mA.

In a state where the lights emitted from the optical exciters 170 and 170' are located at the specific area (P1, P2 and P3), when the red light emitting device (or the second light emitting device) becomes an on-state, that is to say, when a predetermined driving current is applied from the power supply unit 190 to the red light emitting device (or the second light emitting device), the lights emitted from the optical exciters 170 and 170' may move from the specific area (P1, P2 and P3) to the target color coordinate range (Ansi 3000K). Here, the driving current which is applied from the power supply unit 190 to the red light emitting device (or the second light emitting device) may be from 240 mA to 350 mA.

As such, in the lighting devices according to the two embodiments shown in FIGS. 1 and 2, the light located within the specific area (P1, P2 and P3) on the CIE 1931 chromaticity diagram can be moved within the target color coordinate range (for example, Ansi 3000K) by applying the predetermined driving current to the red light emitting device (or the second light emitting device) among the plurality of the light emitting devices 133. Therefore, an intended color temperature can be implemented, and when the target color coordinate range is located on or adjacent to a black body locus, a high CRI can be implemented.

The following table 1 shows experimental data demonstrating the effects of the described lighting devices according to the two embodiments shown in FIGS. 1 and 2.

TABLE 1

| | optical exciters (170, 170') | | | driving current(mA) | | | | | |
|---|---|---|---|---|---|---|---|---|---|
| | first phosphor (wt %) | second phosphor (wt %) | third phosphor (wt %) | blue light emitting device (or the first light emitting device) | red light emitting device (or the second light emitting device) | Cx | Cy | CCT (K) | CRI (Ra) |
| Case 1 | 12.5-15.5 | — | — | 250-270 | — | 0.3410 | 0.4339 | 4304 | 66 |
| | | | | 250-270 | 240-260 | 0.4396 | 0.3980 | 2922 | 92 |
| Case 2 | — | 4.5-7.5 | 5.5-8.5 | 210-230 | — | 0.3437 | 0.4491 | 5220 | 63 |
| | | | | 210-230 | 320-340 | 0.4354 | 0.4071 | 3066 | 90 |
| Case 3 | — | 5.5-8.5 | 4.5-7.5 | 220-240 | — | 0.3436 | 0.4427 | 5215 | 64 |
| | | | | 220-240 | 325-345 | 0.4369 | 0.4096 | 3061 | 90 |

Referring to the above Table 1, the case 1 shows that the optical exciters 170 and 170' include a first single phosphor. Here, a weight percent (wt %) of the first phosphor is from 12.5 to 15.5.

In the case 1, when the driving current of from 250 mA to 270 mA is applied from the power supply unit 190 to only the blue light emitting device (or the first light emitting device), the color coordinates of the light emitted from the optical exciters 170 and 170' are (0.3410, 0.4339) on the CIE 1931 chromaticity diagram. The color coordinates are located within the specific area P1, P2, and P3 shown in FIG. 3.

Meanwhile, when the driving current of from 250 mA to 270 mA is applied from the power supply unit 190 to the blue light emitting device (or the first light emitting device) and when the driving current of from 240 mA to 260 mA is applied from the power supply unit 190 to the red light emitting device (or the second light emitting device), the color coordinates of the light emitted from the optical exciters 170 and 170' are (0.4396, 0.3980) on the CIE 1931 chromaticity diagram. It can be found that the color coordinates are located within the target color coordinate range (Ansi 3000K) shown in FIG. 3, and the CRI is improved from 66 (Ra) to 92 (Ra).

Referring back to Table 1, the case 2 shows that the optical exciters 170 and 170' include the second phosphor and the third phosphor. Here, a weight percent (wt %) of the second phosphor is from 4.5 to 7.5, and a weight percent (wt %) of the third phosphor is from 5.5 to 8.5.

In the case 2, when the driving current of from 210 mA to 230 mA is applied from the power supply unit 190 to only the blue light emitting device (or the first light emitting device), the color coordinates of the light emitted from the optical exciters 170 and 170' are (0.3437, 0.4491) on the CIE 1931 chromaticity diagram. The color coordinates are located within the specific area P1, P2, and P3 shown in FIG. 3.

Meanwhile, when the driving current of from 210 mA to 230 mA is applied from the power supply unit 190 to the blue light emitting device (or the first light emitting device) and when the driving current of from 320 mA to 340 mA is applied from the power supply unit 190 to the red light emitting device (or the second light emitting device), the color coordinates of the light emitted from the optical exciters 170 and 170' are (0.4354, 0.4071) on the CIE 1931 chromaticity diagram. It can be found that the color coordinates are located within the target color coordinate range (Ansi 3000K) shown in FIG. 3, and the CRI is improved from 63 (Ra) to 90 (Ra).

Referring back to Table 1, the case 3 shows that the optical exciters 170 and 170' include the second phosphor and the third phosphor. The case 3 is the same as the case 2 except for the fact the weight percents (wt %) of the second and third phosphors are different from each other. Specifically, the weight percent (wt %) of the second phosphor is from 5.5 to 8.5, and the weight percent (wt %) of the third phosphor is from 4.5 to 7.5.

In the case 3, when the driving current of from 220 mA to 240 mA is applied from the power supply unit 190 to only the blue light emitting device (or the first light emitting device), the color coordinates of the light emitted from the optical exciters 170 and 170' are (0.3436, 0.4427) on the CIE 1931 chromaticity diagram. The color coordinates are located within the specific area P1, P2, and P3 shown in FIG. 3.

Meanwhile, when the driving current of from 220 mA to 240 mA is applied from the power supply unit 190 to the blue light emitting device (or the first light emitting device) and when the driving current of from 325 mA to 345 mA is applied from the power supply unit 190 to the red light emitting device (or the second light emitting device), the color coordinates of the light emitted from the optical exciters 170 and 170' are (0.4369, 0.4096) on the CIE 1931 chromaticity diagram. It can be found that the color coordinates are located within the target color coordinate range (Ansi 3000K) shown in FIG. 3, and the CRI is improved from 64 (Ra) to 90 (Ra).

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A lighting device comprising:

a light source which includes a blue light emitting device emitting blue light in a visible light spectrum, and a red light emitting device emitting red light;

an optical exciter which is disposed on the light source, is spaced apart from the blue light emitting device and the red light emitting device, and includes at least one phosphor; and a power supply unit which is electrically connected to the light source and controls on/off of the blue light emitting device and the red light emitting device, wherein when the blue light emitting device is an on-state and the red light emitting device is an off-state by the power supply unit, light emitted from the optical exciter is disposed within a specific area on a CIE 1931 chromaticity diagram, wherein the specific area is formed by connecting three color coordinates, and the three color coordinates are (0.32, 0.4), (0.36, 0.5) and (0.368, 0.49), wherein when the blue light emitting device and the red light emitting device are an on-state, the light emitted from the optical exciter is disposed within a predetermined target color coordinate range on the CIE 1931 chromaticity diagram, and wherein the blue light emitting device has a dominant wavelength of from 430 nm to 480 nm and the second light emitting device has a dominant wavelength of from 600 nm to 650 nm.

2. The lighting device of claim 1, wherein a driving current which is applied from the power supply unit to the blue light emitting device is from 200 mA to 300 mA.

3. The lighting device of claim 1, wherein a driving current which is applied from the power supply unit to the red light emitting device is from 240 mA to 350 mA.

4. The lighting device of claim 1, wherein the phosphor of the optical exciter comprises a first phosphor having a dominant wavelength of from 557.5 nm to 562 nm.

5. The lighting device of claim 4, wherein a weight percent (wt %) of the first phosphor is from 12.5 to 15.5, wherein a driving current which is applied from the power supply unit to the blue light emitting device is from 250 mA to 270 mA, and wherein a driving current which is applied from the power supply unit to the red light emitting device is from 240 mA to 260 mA.

6. The lighting device of claim 1, wherein the phosphor of the optical exciter comprises a second phosphor having a dominant wavelength of from 537.5 nm to 542.5 nm and a third phosphor having a dominant wavelength of from 547.5 nm to 552.5 nm.

7. The lighting device of claim 6, wherein a weight percent (wt %) of the second phosphor is from 4.5 to 7.5, wherein a weight percent of the third phosphor is from 5.5 to 8.5, wherein a driving current which is applied from the power supply unit to the blue light emitting device is from 210 mA to 230 mA, and a driving current which is applied from the power supply unit to the red light emitting device is from 320 mA to 340 mA, and wherein the target color coordinate range is Ansi 3000K.

8. The lighting device of claim 6, wherein a weight percent (wt %) of the second phosphor is from 5.5 to 8.5, wherein a weight percent of the third phosphor is from 4.5 to 7.5, wherein a driving current which is applied from the power supply unit to the blue light emitting device is from 220 mA to 240 mA, and a driving current which is applied from the power supply unit to the red light emitting device is from 325 mA to 345 mA, and wherein the target color coordinate range is Ansi 3000K.

9. The lighting device of claim 1, wherein the target color coordinate range is located on or adjacent to a black body locus on the CIE 1931 chromaticity diagram.

10. The lighting device of claim 1, further comprising a heat sink in which the light source is disposed, wherein the power supply unit is disposed under or within the heat sink, and wherein the heat sink has a hole in which a conductive member which electrically connects the power supply unit and the light source is disposed.

11. The lighting device of claim 10, further comprising a reflector disposed on the heat sink, wherein a lower portion of the reflector is coupled to the heat sink, and wherein the optical exciter is disposed on an upper portion of the reflector.

12. The lighting device of claim 11, wherein the light source comprises a substrate on which the blue light emitting device and the red light emitting device are disposed, wherein the reflector has a reflective surface, and wherein an angle between the reflective surface and a top surface of the substrate is equal to or greater than 90° to less than and not equal to 180°.

13. The lighting device of claim 1, wherein the optical exciter has a flat plate shape.

14. The lighting device of claim 1, wherein the optical exciter comprises at least one of a yellow phosphor, a green phosphor and a red phosphor.

15. A lighting device comprising:

a light source which includes a blue light emitting device emitting blue light in a visible light spectrum, and a red light emitting device emitting red light;

an optical exciter which is disposed on the light source, is spaced apart from the blue light emitting device and the red light emitting device, and includes at least one phosphor; and a power supply unit which is electrically connected to the light source and controls on/off of the blue light emitting device and the red light emitting device, wherein when the blue light emitting device is an on-state and the red light emitting device is an off-state by the power supply unit, light emitted from the optical exciter is disposed within a specific area on a CIE 1931 chromaticity diagram, wherein the specific area is formed by connecting three color coordinates, and the three color coordinates are (0.32, 0.4), (0.36, 0.5) and (0.368, 0.49), wherein when the blue light emitting device and the red light emitting device are an on-state, the light emitted from the optical exciter is disposed within a predetermined target color coordinate range on the CIE 1931 chromaticity diagram, and wherein the optical exciter has a spherical shape or a hemispherical shape.

16. The lighting device of claim 1, further comprising a heat sink, wherein the optical exciter is coupled to the heat sink.

17. A lighting device comprising:

a heat sink;

a light source including a substrate disposed on one side of the heat sink, at least one first LED chip which is disposed on a top surface of the substrate and has a dominant wavelength of from 430 nm to 480 nm, and at least one second LED chip which is disposed on the top surface of the substrate and has a dominant wavelength of from 600 nm to 650 nm;

an optical exciter emitting excites and emits light emitted from the first LED chip and the second LED chip; and a power supply unit which controls on/off of the first LED chip and the second LED chip, wherein when the first LED chip is an on-state and the second LED chip is an off-state by the power supply unit, light emitted from the optical exciter is disposed within a specific area on a CIE 1931 chromaticity diagram, wherein the specific area is formed by connecting three color coordinates, and the three color coordinates are (0.32, 0.4), (0.36, 0.5) and (0.368, 0.49), and wherein when the first LED chip and the second LED chip are an on-state, the light emitted from the optical exciter is disposed within a predetermined target color coordinate range on the CIE 1931 chromaticity diagram.

18. The lighting device 18, wherein a driving current which is applied from the power supply unit to the first LED chip is from 200 mA to 300 mA.

19. The lighting device of claim 17, wherein a driving current which is applied from the power supply unit to the second LED chip is from 240 mA to 350 mA.

20. The lighting device of claim 1, wherein the optical exciter has a spherical shape or a hemispherical shape.

* * * * *